United States Patent [19]

Lieb et al.

[11] 4,000,720

[45] Jan. 4, 1977

[54] VAPOR GENERATOR

[75] Inventors: Carl Lieb, Norton; Edward J. Piaskowski, Massillon, both of Ohio

[73] Assignee: The Babcock & Wilcox Company, New York, N.Y.

[22] Filed: Aug. 18, 1975

[21] Appl. No.: 605,564

[52] U.S. Cl. ..... 122/510; 122/6 A; 122/406 S

[51] Int. Cl.[2] ..... F22B 29/06; F22B 37/24

[58] Field of Search ..... 122/6 A, 235 A, 406 S, 122/406 SU, 510

[56] References Cited

UNITED STATES PATENTS

| | | | |
|---|---|---|---|
| 3,162,179 | 12/1964 | Strohmeyer | 122/406 |
| 3,834,358 | 9/1974 | Frendberg et al. | 122/406 |
| 3,927,646 | 12/1975 | Dungey et al. | 122/406 |

*Primary Examiner*—Kenneth W. Sprague
*Attorney, Agent, or Firm*—Joseph M. Maguire; Robert J. Edwards

[57] ABSTRACT

A forced flow vapor generator wherein at least one of the upright boundary walls of the furnace has upper and lower portions formed of panels of upwardly extending laterally spaced tubes rigidly united throughout most of their length. Some of the panels of the upper and lower wall portions have segments thereof interlaced and coextensive with each other, the interlaced segments being rigidly united to transmit the load of the lower wall portion to the upper wall portion.

4 Claims, 8 Drawing Figures

VAPOR GENERATOR

BACKGROUND OF THE INVENTION

The invention relates generally to the construction of a forced flow fluid heating unit, and more particularly to improvements in the construction and arrangement of fluid heating circuits especially adapted for use as a furnace wall support.

The present invention is directed at improvements in the construction of forced circulation once-through vapor generators of the type disclosed in U.S. Pat. Nos. 3,665,893 and 3,834,358 wherein the upright boundary walls of the furnace are subdivided into upper and lower portions and include at least one separate continuous upflow fluid heating pass in each of the wall portions with tube segments of the separate fluid heating passes forming a common plane wherein they are interlaced and coextensive, while above and below this common plane, the tubes are bent outwardly of the plane of the wall and connected to suitably arranged headers which allow for equalization of enthalpies as the fluid flows from one heating pass to the other.

The construction of walls of the character described is costly and time consuming in that it requires the individual bending of relatively short tube lengths and the manual welding of each of these tube lengths above and below the common plane formed by the interlaced tube segments of the fluid heating passes.

SUMMARY OF THE INVENTION

The present invention relates to a forced circulation fluid heating unit having a furnace chamber bounded by upright walls formed with upper and lower portions and including mixing headers receiving fluid from the lower wall portions and discharging the mixed fluid to the upper wall portions.

In accordance with the invention, the upper and lower furnace wall portions are formed of panels of upwardly extending laterally spaced tubes rigidly united throughout most of their length. Some of the tube panels of the upper and lower wall portions are bent out of the plane of the wall at first and second levels, respectively, for connection to the mixing headers and are interlaced with each other in the plane of the wall between the first and second levels. The remaining tube panels of the upper and lower wall portions are bent out of the plane of the wall at about the second and first levels, respectively, for connection to the mixing headers. The interlaced panel segments of the upper and lower furnace wall portions are rigidly united to transmit the load of the lower wall portion to the upper wall portion.

The present invention realizes substantial time and cost savings by providing shop assembled panels of parallel coplanar tubes with the tubes of each panel being rigidly united through machine welding of webs therebetween and being collectively bent out of the intended plane of the wall.

DESCRIPTION OF THE PREFERRED EMBODIMENTS

Figure 1:
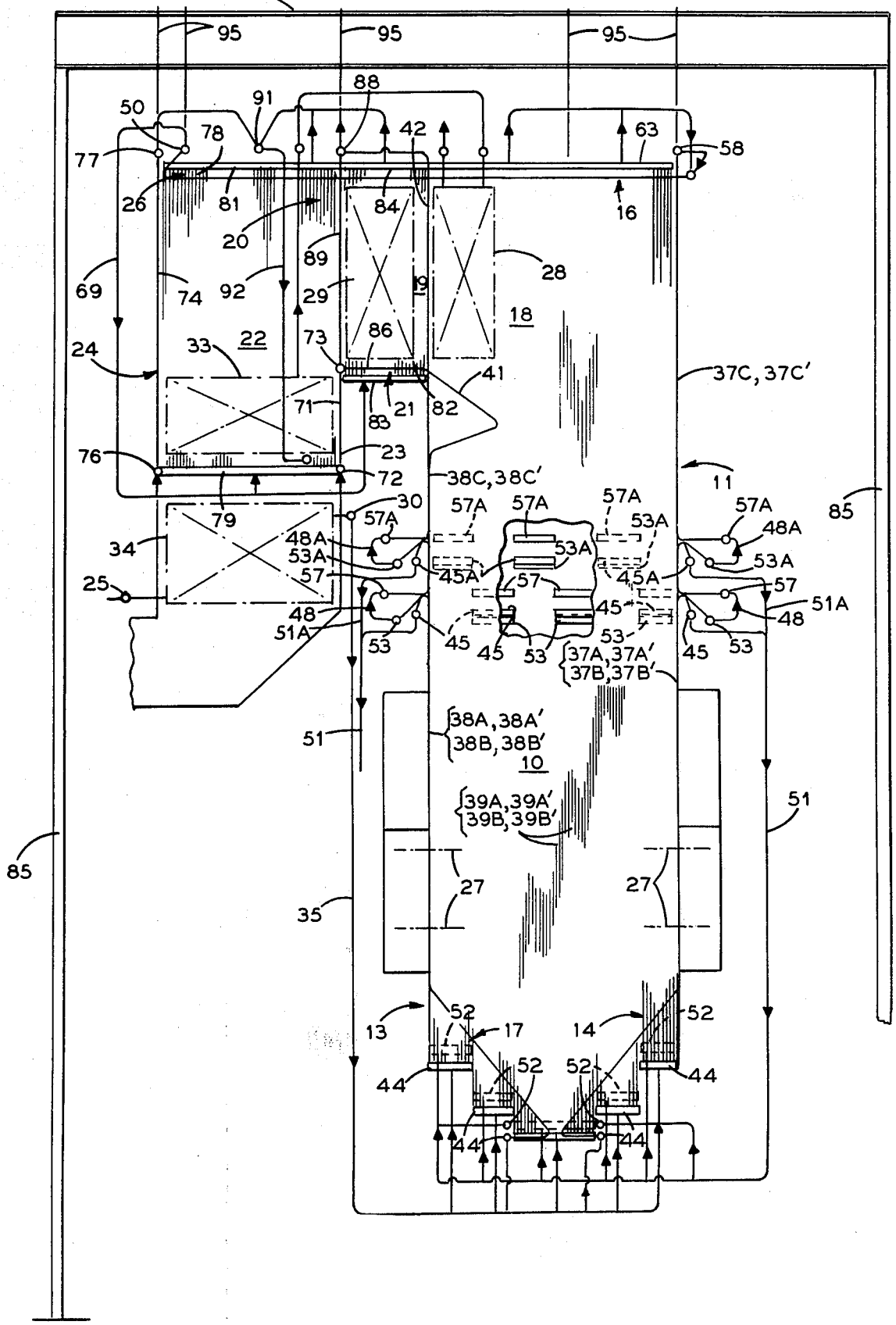
FIG. 1 is a sectional side elevation of a once-through forced flow vapor generator embodying the invention.

In the drawings, the invention has been illustrated as embodied in a top-supported force flow once-through vapor generator intended for central station use. The main portions of the unit, as illustrated in FIG. 1, include an upright furnace chamber 10 of substantially rectangular horizontal cross section defined by a front wall 11, rear wall 13, side walls 14, a roof 16 and a hopper 17. The upper end of the furnace chamber 10 is formed with a gas outlet 18 opening to a horizontally extending gas passageway 19 of rectangular vertical cross section and defined by a floor 21 and extensions of the furnace roof 16 and side walls 14 and 20. The gas passageway 19 communicates at its rear end with the upper end of an upright gas passageway 22 of rectangular horizontal cross section and defined by a front wall 23, a rear wall 24, side walls 26, and an extension of the roof of gas passageway 19.

The fuel firing section comprises vertically spaced rows of burners 27 disposed on opposite walls 11 and 13 at the lower portion of furnace chamber 10.

The gas passageway 19 houses a secondary superheater 28 and a reheater 29 disposed in series with respect to gas flow while gas passageway 22 houses a primary super-heater 33 and an economizer 34 disposed in series with respect to gas flow.

In the normal operation of the vapor generator, combustion air and fuel are supplied to the burners 27 and the fuel is burned in the lower portion of furnace chamber 10. The combustion gases flow upwardly through chamber 10 to the furnace outlet, thence over and between the tubes of secondary superheater 28 and reheater 29 in gas passageway 19 and over and between the tubes of primary superheater 33 and economizer 34 in gas passageway 22, and then to air preheaters, not shown, before discharge to a stack, not shown. It should be recognized that in accordance with well known practice, each of the superheated and reheater sections extends across the full width of its corresponding gas passageway and is formed for serial flow of steam through multiple looped tubes.

The vapor generator setting is top supported by structural members including upright members 85 and girders 90 from whence hangers 95, of which only a few are illustrated support the walls and convection surfaces.

Feedwater at high pressure is supplied by one or more pumps, not shown, to the economizer inlet header 25 for passage through the tubes of economizer 34 to the outlet header 30, from whence it is conveyed by one or more downcomers 35 to the boundary wall fluid heating circuitry of the furnace chamber 10.

The upright boundary walls of passageways 19 and 22 are of gastight construction and include the front wall 23 having tubes 71 extending between the inlet and outlet headers 72 and 73. The rear wall 24 has tubes 74 extending between the inlet and outlet headers 76 and 77. The sidewalls 26 have tubes 78 extending between the inlet and outlet headers 79 and 81, and the sidewalls 20 have tubes 82 extending between the inlet and outlet headers 83 and 84. The floor 21 is lined by a row of tubes 86 having their inlet ends connected to the header 57 and their outlet ends to the header 73, with the latter being connected to the header 88 through a row of screen tubes 89.

The headers 72, 76, 79 and 83 are connected for parallel supply of fluid from roof header 50 through the conduit 69, while the headers 77, 81, 84 and 88 are connected for discharge to a collector header 91 from whence fluid passes to the primary superheater 33 via conduit 92. The superheated vapor passes from the primary superheater 33 to the secondary superheater 28 wherein it is further super-heated before passing to a high pressure turbine, not shown. The partially expanded vapor exiting from the high pressure turbine passes through the reheater 29, and from there to a low pressure turbine, not shown, wherein final expansion takes place.

Each of the upright boundary walls of furnace 10 is formed by upwardly extending parallel tubes arranged to provide three upflow fluid heating passes and having their intertube spacing closed by metallic webs welded to adjacent tubes to provide a gastight construction. The first two fluid heating passes comprise a first group of tubes and form the lower portion of each furnace wall and the third fluid heating pass comprises a second group of tubes and forms the upper portion of each furnace wall. Special header provisions are made for mixing the heat absorbing medium intermediate its flow from one pass to another, the mixing system from each of the fluid heating passes being specifically directed at keeping the wall tube temperature differentials across the width of the furnace walls to a minimum. With differences in furnace cleanliness as well as in the flow rates through the multiple parallel fluid flow paths it is possible to develop temperature differences between adjacent tubes of a magnitude sufficient to induce high stresses in the tubes and in the metallic webs therebetween. By limiting the total absorption in a fluid heating pass, the degree of thermal imbalance within the tubes comprising the parallel flow paths is also limited. Accordingly, the boundary wall of the furnace is designed so that the temperature at a particular level of furnace height or elevation differs by no more than 100° F from the calculated average fluid temperature of all furnace wall tubes at that level, thus, calculated maximum temperature differential between adjacent tubes is below the predetermined critical limit to minimize the effect of fluid flow imbalances; and so that the tubes of each fluid heating pass are sufficient in flow area to provide an adequate circulation rate. Furthermore, all heated tubes of the furnace boundary walls are arranged for upflow of fluid, since flow stability within heating passes having their tubes so arranged is markedly improved over that condition where flow circuitry has heated downflow as well as upflow tubes. In other words flow imbalances for the same average and upset heat absorption conditions are considerably less severe with all upflow tubes than with both upflow and downflow circuitry within a heat absorbing zone.

The front wall 11 includes first pass upflow tubes 37A, 37A', second pass upflow tubes 37B, 37B', and third pass upflow tubes 37C, 37C'. The rear wall 13 includes first pass upflow tubes 38A, 38A' second pass upflow tubes 38B, 38B', and third pass upflow tubes 38C, 38C'. Some of the latter tubes form a screen 42 ahead of gas passageway 19 and the remainder form a furnace nose arch 41. Each sidewall 14 includes first pass upflow tubes 39A, 39A', second pass upflow tubes 39B, 39B' and third pass upflow tubes 39C, 39C'.

The first pass upflow tubes 37A, 37A', 38A, 38A' and 39A, 38A' have the lower ends connected to inlet headers 44 associated with the corresponding walls. The tubes 37A, 38A and 39A have their upper ends connected to outlet headers 45, whereas the tubes 37A', 38A' and 39A' have their upper ends connected to outlet headers 45A located superjacent to the headers 45.

The second pass upflow tubes 37B, 37B', 38B, 38B' and 39B, 39B' have their lower ends connected to inlet headers 52 associated with the corresponding walls. The tubes 37B, 38B and 39B have their upper ends connected to outlet headers 53, whereas the tubes 37B', 38B' and 39B' have their upper ends connected to outlet headers 53A located superjacent to the headers 53.

The third pass upflow tubes 37C, 38C and 39C have their lower ends connected to inlet headers 57, and the third pass upflow tubes 37C', 38C' and 39C' have their lower ends connected to inlet headers 57A located superjacent to the headers 57. The tubes 37C and 37C' have their upper ends connected to the furnace roof supply header 58. Some of the tubes 38C and 38C' have upper ends connected to the tube screen inlet header 73 and the remaining tubes 38C and 38C' have their upper ends connected to the tube screen outlet header 88. The tubes 39C and 39C' have their upper ends connected to outlet headers 63.

A conduit 35 supplies fluid from the economizer 34 to the inlet headers 44, from whence it is conveyed through the first pass upflow tubes 37A, 37A', 38A, 38A' and 39A, 39A' and is collected at the first pass outlet headers 45 and 45A, and thence conveyed through conduits 51 and 51A to second pass inlet headers 52 associated with the corresponding walls. Fluid from the headers 52 is conveyed through the second pass upflow tubes 37B, 37B', 38B, 38B' and 39B, 39B' and is collected at the second pass outlet headers 53 and 53A, and thence conveyed through conduits 48 and 48A to third pass inlet headers 57 and 57A. The fluid flowing through the conduits 48 and 48A could be directed to one or more larger headers, not shown, for further mixing prior to introduction into the corresponding third pass inlet headers 57 and 57A. Fluid from the headers 57 and 57A, associated with the rear wall 13, is conveyed through the third pass upflow tubes 38C and 38C', respectively, and is collected at the tube screen headers 73 and 88. Fluid from the headers 57 and 57A, associated with the front wall 11, is conveyed through the third pass upflow tubes 37C and 37C', respectively, and is collected at the roof supply header 58. Fluid from the headers 57 and 57A, associated with the side walls 14, is conveyed through the third pass upflow tubes 39C and 39C', respectively, and is collected at the outlet headers 63.

From the foregoing description, it is evident that tubes 37A, 37A', 38A, 38A' and 39A, 39A' constitute the first fluid heating pass, tubes 37B, 37B', 38B, 38B' and 39B, 39B' constitute the second fluid heating pass, and tubes 37C, 37C', 38C, 38C' and 39C, 39C' constitute the third fluid heating pass. The tubes of the first fluid heating pass are disposed in spaces between tubes of the second fluid heating pass and have their intertube spaces closed by metallic webs, weld-united to the tubes along substantially their entire parallel lengths so that each web is welded to one of the tubes of the first heating pass and to one of the tubes of the second heating pass. Tubes of the third fluid heating pass, with the exception of the screen portions, have their intertube spaces closed by metallic webs weld united to the tubes. The tubes of the first and second fluid heating passes are coplanar along almost their entire length within their respective walls and are also coplanar with the tubes of the associated third fluid heating passes of the corresponding wall except for portions of the rear wall.

Since the construction and arrangement of the fluid collection, mixing and distribution system and their associated tubes are substantially the same for all of the furnace walls, it will suffice to describe the system corresponding to the front wall 11.

Figure 2:
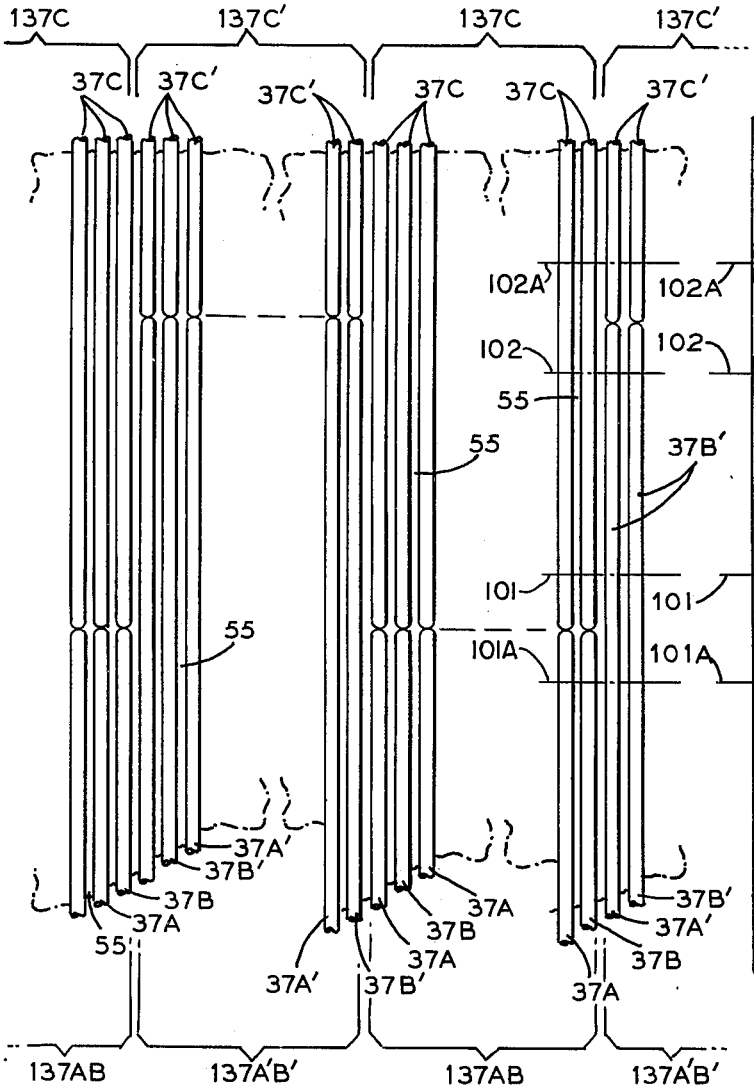
FIG. 2 is an enlarged front view of a portion of the fluid collection, mixing and distribution system shown in FIG. 1.
Figure 3:
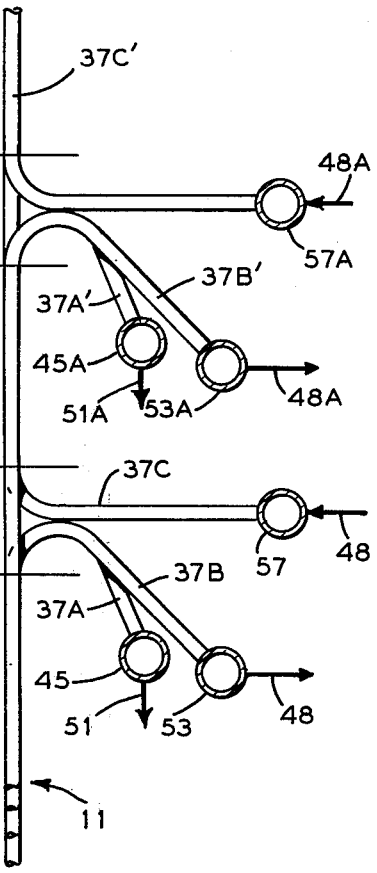
FIG. 3 is an enlarged side view of that portion of the system shown in FIG. 2.

Referring to FIGS. 2 and 3, there are shown fragmented sectional views of the front wall 11 including the panels 137AB whose first and second pass tubes 37A and 37B have their upper end portions bent outwardly from the plane of the wall at about the first level 101A and extending downwardly for connection to individual corresponding first and second pass outlet headers 45 and 53, respectively, and the panels 137A'B' whose first and second pass tubes 37A' and 37B' have their upper end portions bent outwardly from the plane of the wall at the second level 102 and extending downwardly for connection to individual corresponding first and second pass outlet headers 45A and 53A, respectively. The fluids collected in the first pass outlet headers 45 and 45A are passed, via conduits 51 and 51A to the second pass inlet headers 52. The fluids collected in the second pass outlet headers 53 are passed, via conduit 48, to corresponding third pass inlet headers 57 for distribution to the panels 137C whose third pass tubes 37C have their lower end portions extending, from individual corresponding inlet headers 57, horizontally inward and bent upwardly to enter the front wall 11 at the first level 101 from whence they extend upwardly in the plane of the wall. The fluids collected in the second pass outlet headers 53A are passed via conduit 48A to corresponding third pass inlet headers 57A for distribution to the panels 137C' whose third pass tubes 37C' have their lower end portions extending, from individual corresponding inlet headers 57A, horizontally inward and bent upwardly to enter the front wall 11 at about the second level 102A from whence they extend upwardly in the plane of the wall. Metallic webs 55 close the intertube spaces and are normally seal welded to the adjoining tubes.

Figure 4:
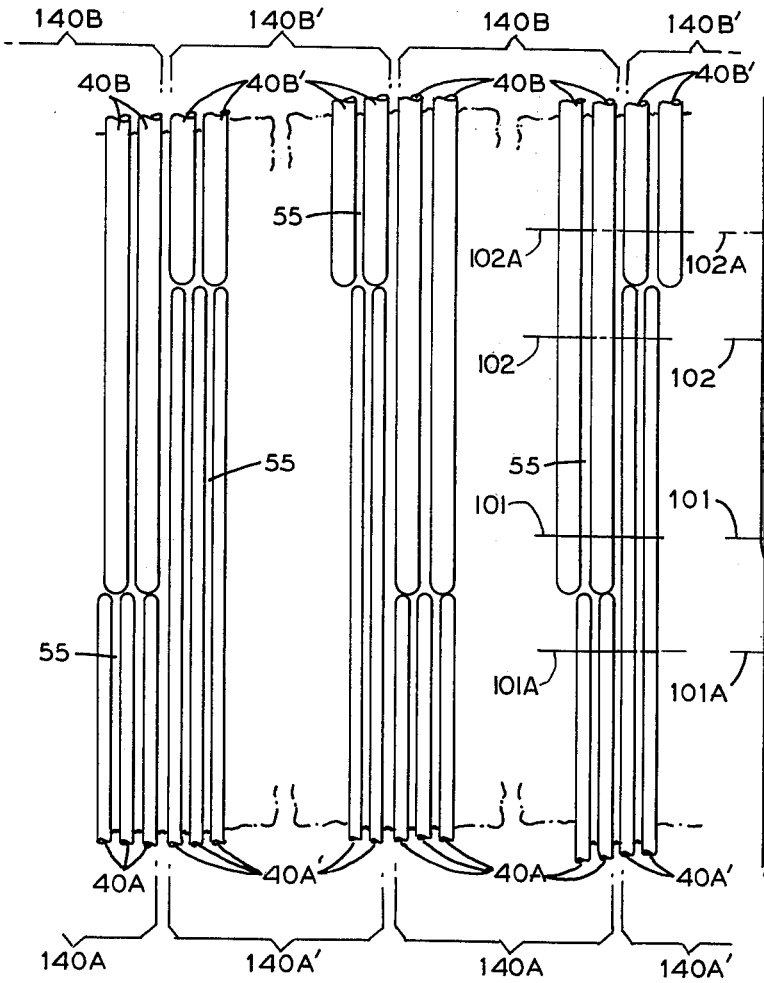
FIG. 4 is an enlarged front view of a portion of an alternate fluid collection, mixing and distribution system.
Figure 5:
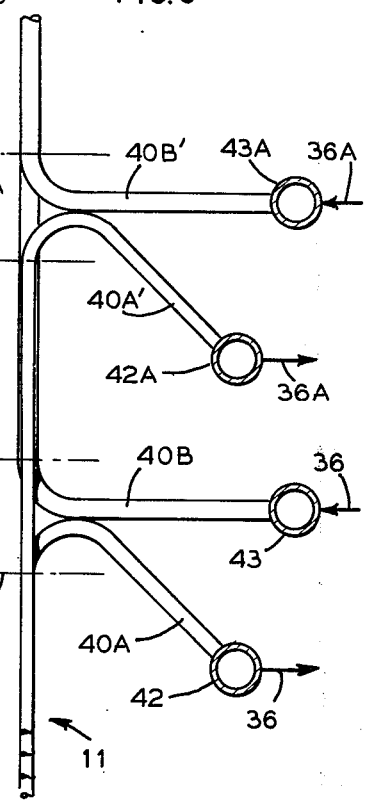
FIG. 5 is an enlarged side view of that portion of the system shown in FIG. 4.

An alternate embodiment of the fluid collection, mixing and distribution system is illustrated in FIGS. 4 and 5 and has each of the upright boundary walls of the furnace formed by upwardly extending parallel tubes arranged to provide two upflow fluid heating passes. The first fluid heating pass comprises a first group of tubes and forms the lower section of each furnace wall and the second fluid heating pass comprises a second group of tubes and forms the upper portion of each furnace wall.

Since construction and arrangement of the fluid collection, mixing and distribution systems and their associated tubes are substantially the same in all walls, it will suffice to describe the system corresponding to the front wall 11.

Referring to FIGS. 4 and 5, there are shown fragmented sectional views of the front wall 11 including the panels 140A whose first pass tubes 40A have their upper end portions bent outwardly from the plane of the wall at about the first level 101A and extending downwardly for connection to individual corresponding first pass outlet headers 42, and the panels 140A' whose first pass tubes 40A' have their upper end portions bent outwardly from the plane of the wall at the second level 102 and extending downwardly for connection to individual corresponding first pass outlet headers 42A. The fluids collected in the first pass outlet headers 42 are passed, via conduit 36, to corresponding second pass inlet headers 43 for distribution to the panels 140B whose second pass tubes 40B have their lower end portions extending from individual corresponding inlet headers 43 horizontally inward and bent upwardly to enter the front wall 11 at the first level 101 from whence they extend upwardly in the plane of the wall. The fluids collected in the first pass outlet headers 42A, are passed via conduit 36A to corresponding second pass inlet headers 43A for distribution to the panels 140B' whose second pass tubes 40B' have their lower ends extending from individual corresponding inlet header 43A horizontally inwardly to enter the front wall 11 at about the second level 102A from whence they extend upwardly in the plane of the wall. Metallic webs 55 close the intertube spaces and are normally seal-welded to the adjoining tubes. The alternative embodiment is shown with second pass tubes 40B and 40B' having a larger diameter and wider intertube spacing as compared to the first pass 40A and 40A',however, it should be recognized that other combinations of tube sizing and spacing may be used with the invention.

Figure 7:
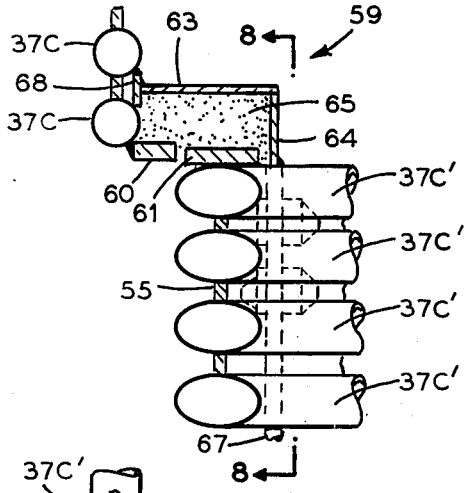
FIG. 7 is a view taken along line 7—7 of FIG. 6.
Figure 8:
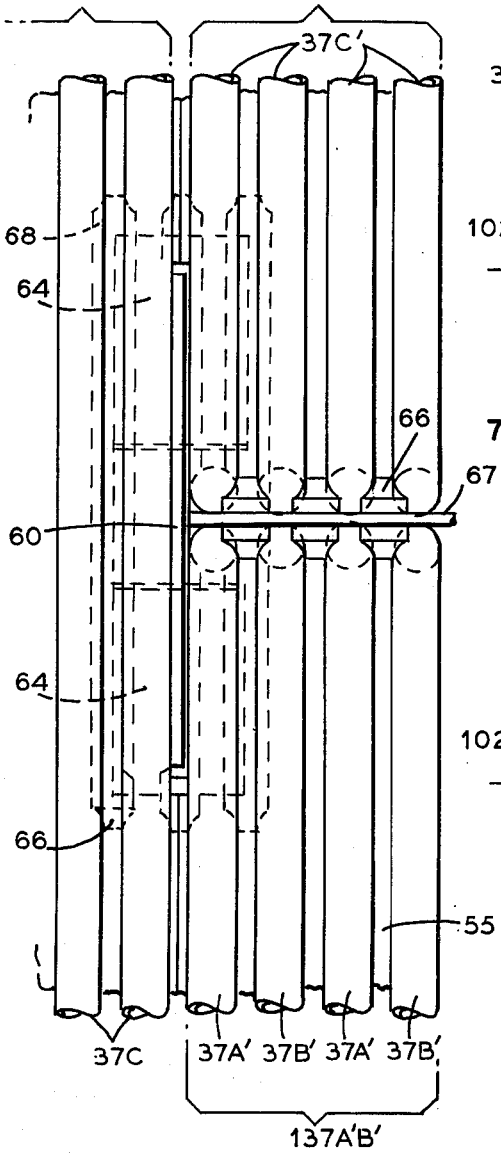
FIG. 8 is a view taken along line 8–8 of FIG. 7.
Figure 6:
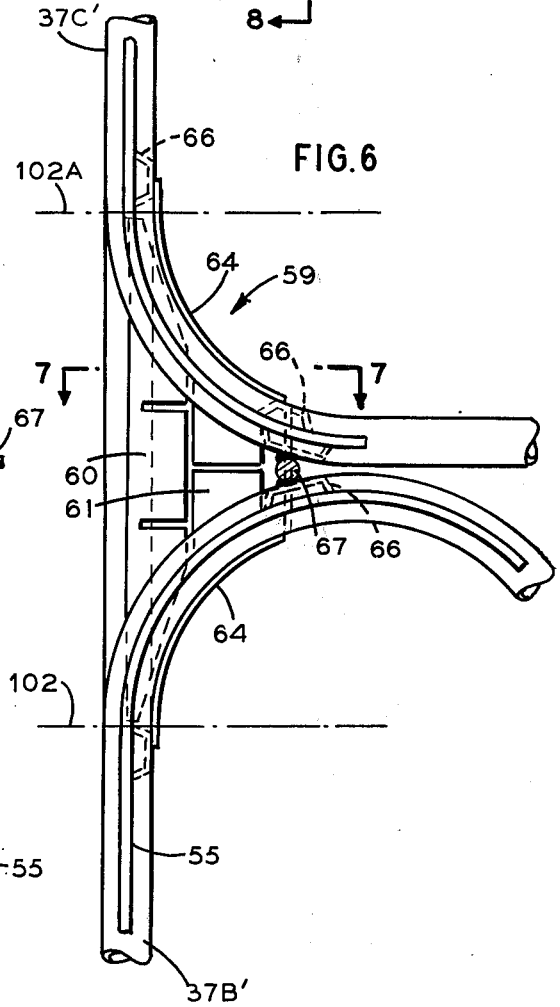
FIG. 6 is a detail side view of the wall sealing arrangement used with the fluid collection, mixing and distribution system.

Referring to FIGS. 6, 7 and 8, there are shown sectional side, plan and front views, respectively, of a sealing arrangement provided at the crotch formed between the levels 102 and 102A. It should be recognized that the sealing arrangement depicted herein is equally applicable to the crotch formed by the tube bends at levels 101 and 101A and those formed at like levels for the alternate embodiment. Accordingly, there are shown the panel 137C whose tubes 37C extend upwardly in the plane of the front wall 11, the panel 137AB' whose tubes 37A' and 37B' have their upper end portions bent outwardly from the plane of the wall at the second level 102, and the panel 137C' whose tubes 37C' have their lower end portions bent outwardly from the plane of the wall at about the second level 102A. The crotch sealing arrangement between the levels 102 and 102A includes a seal box 59 defined by a slotted plate 60 and flat plates 61, a side plate 63, and back plates 64, the latter being curved to follow the contour of the bent portions of tubes 37A', 37B' and 37C'. The box 59 is packed with refractory material 65 to provide a gastight seal at the juncture of panel 137C and the bent tube portions of panels 137A'B' and 137C' between the levels 102 and 102A. Plate inserts 66 are fitted between adjacent tubes and are weldably connected thereto and to a rod 67 which seals the crotch formed by the bent portions of tubes 37A', 37A' and 37C'. Additional inserts 66 and flat bars 68 are provided to connect the seal box 59 with the adjoining tube panels.

By way of example and not of limitation, and with reference to the main embodiment, each of the panels in the upper and lower furnace wall portions is approximately 64 inches wide and contains 37 tubes of 1.25 inch outside diameter which are spaced on 1.75 inch centers. The alternate embodiment has panels of the same width as the main embodiment, however, each of the panels in the upper furnace wall portion contains 28 tubes of 1.5 inch outside diameter which are spaced on 2.25 inch centers.

While in accordance with provisions of the statutes there is illustrated and described herein a specific embodiment of the invention, those skilled in the art will understand that changes may be made in the form of the invention covered by the claims, and that certain features of the invention may sometimes be used to advantage without a corresponding use of the other features.

The embodiment of the invention in which an exclusive property or privilege is claimed are defined as follows:

1. In a forced circulation fluid heating unit, upright walls forming a furnace chamber, at least one of the walls including upper and lower panels, each of said panels being comprised of a multiplicity of upwardly extending laterally spaced tubes rigidly united throughout most of their length, mixing header means receiving fluid from the lower panels and discharging the mixed fluid to the upper panels, some of said upper and lower panels being bent out of the plane of the wall at first and second levels, respectively, for connection to the header means and interlaced with and laterally spaced from each other in the plane of the wall between the first and second levels, the first level being subjacent the second level, the remaining upper and lower panels being bent out of the plane of the wall at about the first and second levels, respectively, for connection to the header means, and means for supporting said one wall including metallic webs weld uniting the interlaced upper and lower panels and transmitting the load of the lower panels to the upper panels, and means for top supporting said upper panels.

2. The forced circulation fluid heating unit according to claim 1 wherein some of the tubes in each of the lower panels define a first fluid heating pass and the remaining tubes in said lower panels define a second fluid heating pass, and all of the tubes in the upper panels define a third fluid heating pass.

3. The forced circulation fluid heating unit according to claim 1 wherein the tubes in said lower panels define a first fluid heating pass and the tubes in said upper panels define a second fluid heating pass.

4. The forced circulation fluid heating unit according to claim 1 wherein the internal cross-sectional flow area of the tubes in the upper panels is greater than the internal cross-sectional flow area of the tubes in said lower panels.

* * * * *

UNITED STATES PATENT AND TRADEMARK OFFICE

CERTIFICATE OF CORRECTION

PATENT NO. : 4,000,720

DATED : January 4, 1977

INVENTOR(S) : C. Lieb et al

It is certified that error appears in the above-identified patent and that said Letters Patent are hereby corrected as shown below:

Column 2, line 37 "super-heater" should read --superheater--.

Column 4, line 8 "38A'" should read --39A'--.

Column 6, line 63 "37A'" should read --37B'--.

Signed and Sealed this

*Tenth* Day of *October 1978*

[SEAL]

*Attest:*

RUTH C. MASON
*Attesting Officer*

DONALD W. BANNER
*Commissioner of Patents and Trademarks*